US005964115A

United States Patent [19]

Hansen

[11] Patent Number: 5,964,115

[45] Date of Patent: Oct. 12, 1999

[54] WORK PROCESS FOR APPLYING A DEFINED SURFACE ROUGHNESS TO A METAL STRIP

[75] Inventor: Manfred Hansen, Düsseldorf, Germany

[73] Assignee: Mannesmann AG, Düsseldorf, Germany

[21] Appl. No.: 09/187,174

[22] Filed: Nov. 5, 1998

[30] Foreign Application Priority Data

Nov. 10, 1997 [DE] Germany ..... 197 50 780

[51] Int. Cl.[6] ..... B21B 41/06

[52] U.S. Cl. ..... 72/229; 72/200

[58] Field of Search ..... 72/199, 200, 201, 72/229, 236, 234, 39, 40, 41, 365.2, 366.2, 252.5; 148/650, 651, 547, 548

[56] References Cited

U.S. PATENT DOCUMENTS

| | | | |
|---|---|---|---|
| 2,914,974 | 12/1959 | Cavanaugh et al. | 72/200 |
| 3,950,191 | 4/1976 | Ito et al. | 148/12.1 |
| 4,435,970 | 3/1984 | Sekiya | 72/238 |
| 4,657,685 | 4/1987 | Uematsu et al. | 72/42 |
| 5,555,756 | 9/1996 | Fischer et al. | 72/41 |
| 5,806,359 | 11/1996 | Hequet | 72/229 |

FOREIGN PATENT DOCUMENTS

| | | | |
|---|---|---|---|
| 58-86903-A | 5/1983 | Japan | 72/200 |
| 1-66003-A | 3/1989 | Japan | 72/252.5 |

*Primary Examiner*—Rodney Butler
*Attorney, Agent, or Firm*—Cohen, Pontani, Lieberman & Pavane

[57] ABSTRACT

A process for applying a defined surface roughness to a metal strip, especially steel strip, for preventing the sticking of strip during subsequent annealing in a bell-type annealing installation includes cold rolling the metal strip in at least one reversing roll stand. The cold rolled metal strip is then guided to a temper rolling stand for wet rolling the cold rolled metal strip through at least one pass for applying the defined surface roughness to the metal strip. For this purpose, the flattening rolls of the temper rolling stand are replaced with rough rolls.

9 Claims, No Drawings

WORK PROCESS FOR APPLYING A DEFINED SURFACE ROUGHNESS TO A METAL STRIP

BACKGROUND OF THE INVENTION

1. Field of the Invention

The present invention relates to a process for applying a defined surface roughness to a metal strip. More specifically, the present invention relates to a process for applying a defined surface roughness to a steel strip that is cold rolled in at least one reversing roll stand and coiled for preventing sticking of strip during subsequent annealing in a hood-type or bell-type annealing installation following the reversing roll stand. In addition, a temper rolling stand for at least one planishing or flattening pass is associated with the bell-type annealing installation.

2. Description of the Related Art

Reversing cold rolling mills for producing large tonnages of cold-rolled strip have been extensively replaced by tandem mills comprising multiple stands in which a greater tonnage of strip is more economically rolled. Lately, smaller-production rolling mills, also known as minimills, are increasingly being designed. These minimills are set up in a more customer-oriented manner for economical rolling operations specifically geared to small tonnage production. Reversing cold rolling mills were and are well suited for minimills because investment costs for a rolling mill outfitted with only one or two reversing cold rolling stands are in balance with the quantity of commercial products rolled on such a mill.

In the cold rolling of metal strip and subsequent annealing of the coiled metal strip in bell-type annealing installations, the surfaces of the blank or smooth metal strip contacting each other in tight coils in the bell-type annealing installation may stick together. When this occurs, the overall production process is considerably impeded and may lead to the disposal of the strip. Therefore, the potential for the tightly coiled strip to stick together must be minimized or prevented. In prior-art tandem mills having a plurality of roll stands arranged successively in a line as well as in prior art reversing rolling mills, the sticking problem was solved in that the surface of the strip was roughened prior to the annealing process. In the prior art tandem mills, the last stand arranged in the tandem mill was outfitted with rough work rolls through which the strip was rolled to roughen the strip surface to the appropriate roughness for reliable prevention of adhesion of the strip in the bell-type annealing installation.

In the prior art reversing cold rolling mills, the same sticking problem was solved in that a certain quantity of the strip was initially rolled out by blank or smooth work rolls of the reversing stands and stored. The smooth work rolls were then removed and replaced with work rolls having a suitable roughness. All of the temporarily stored coils of smooth strip then had rolled through a second pass in the rolling mill for applying the required roughness to prevent sticking. It is plain to see that the cost of this step was an enormous increase in production times which had a negative impact on the economy of the reversing cold rolling mill. In addition, as a result of the intermediate storage of the coils, rolling emulsion dried onto the surface of the strip and could be removed subsequently only with difficulty.

In both the prior art tandem cold rolling mills and the prior art reversing cold rolling mills, a deterioration in the evenness of the strip occurs as a result of the heat treating process in the bell-type annealing installation. This deterioration is accounted for by reducing the annealed strip after leaving the bell-type annealing installation in a flattening pass through a temper rolling mill provided especially for this purpose with only slight elongation of about 1–2%. The temper rolling mill works in dry operation and is set up following the bell-type annealing installation. In practice, the temper roll stand is used only for one pass per coil and therefore is not in use during most of the production time required for each coil of the metal strip.

SUMMARY OF THE INVENTION

It is an object of the present invention to provide a process for applying a defined surface roughness to a metal strip which is cold rolled in at least one reversing roll stand and coiled.

It is another object of the invention to provide a process for applying a defined surface roughness to a metal strip that is economical for cold rolling of the metal strip in reversing rolling mills that are used for small production outputs and result in flawless surface quality.

To achieve this object, it is proposed according to the invention that the surface of the cold-rolled metal strip is roughened in the temper rolling stand which is outfitted with devices for wet rolling, wherein the flattening rolls of the temper rolling stand are replaced for this purpose with rough rolls.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PRESENTLY PREFERRED EMBODIMENTS

The present invention is based on the idea that the temper rolling stand which is already necessarily present in reversing rolling mills that are used for small production outputs is seldom worked to full capacity because only a single pass is carried out through the temper roll stand for each coil of the metal strip that is produced. The conversion of the known reversing roll stand with blank rolls to one with roughened rolls impedes the use of the reversing cold rolling mill for all passes to be carried out subsequently. Moreover, this prior art rolling mill cannot be used during the required conversion times. When the existing temper rolling stand is provided with devices for the wet rolling of strip and the smooth rolls are replaced by rough rolls for roughening the surface of the cold-rolled strip according to the invention, the temper rolling stand, which is otherwise used for only a small portion of the entire production time for each coil of metal strip, is tied into the metal strip production process in a useful manner without impeding the capacity of the reversing rolling mill which precedes it.

The temper rolling stand is advantageously outfitted with a cooling and/or washing installation for the strip and the rolls for optimally preparing the strip and the surface of the strip for the subsequent heat treatment process in the bell-type annealing installation.

The cooling and/or washing installation can advantageously be operated with a cleaning detergent. The cleaning detergent is especially well-suited for cleaning the surface of a metal strip coated with grease.

According to the present invention, it is also useful to operate the cooling and/or washing installation with water containing a rustproofing agent. The use of water with the installation is especially economical. Large quantities of water can be applied at the rate of, for example, roughly 1000 l/min to the strip and rolls. The addition of a rustproofing agent to the water prevents oxidation of the strip surface which would be detrimental to the subsequent process.

The roughening of the strip surface is preferably performed directly following the reducing rolls, so that the hot wet strips quickly dry. The quick drying is important for preventing the formation of emulsion spots on the strip such as those occurring as a result of intermediate storage of the coils. Furthermore, the cleaning detergent improves the quality of the strips in combination with the steps described above.

To summarize, the present invention includes the use of a slightly modified temper rolling stand which is already present in the prior art reverse roll mills to roughen the strip prior to the annealing process The temper rolling stand used by the present invention operates with water and a rust protection agent instead of emulsion and also cleans the strip. The loading of the reversing rolling mill is reduced to an appreciable degree according to the invention. The inventive use of the temper rolling stand to roughen the strip reduces the number of roll changes required for strip production compared to the prior art thereby increasing the availability of the reverse rolling mill. According to the inventive process, the still hot, tightly coiled strip wetted with emulsion is not stored for long periods prior to roughening resulting in the production of a cleaner and higher-quality strip.

The process according to the present invention is advantageously applied to a cold-rolled steel strip with final dimensions of a thickness in the range of 0.35 to 1.5 mm thickness and a width in the range of 600 to 1500 mm. The raw strip having a thickness, for example, in the range of 1.5–6 mm is rolled in the reversing roll stand in 3–5 reversing passes to the final thickness mentioned above. After the last reversing pass in the mill, the strip is guided to the temper rolling stand which has been prepared by replacing the flattening rolls with rough work rolls. The surface of the strip is prepared for the annealing process by rough work rolls as the strip is rolled in the temper rolling stand. The rough strip which is coiled following the roughening process in the temper rolling stand is then heat-treated in the bell-type annealing installation. Following the annealing treatment, the coils are finish-rolled in a final pass in the temper rolling stand which has now been refitted with smooth rolls for the flattening pass. Thus, in the inventive process, the reversing roll stand is completely removed from the strip roughening portion of the process and is accordingly used exclusively for reducing the thickness of the strip.

The invention is not limited by the embodiments described above which are presented as examples only but can be modified in various ways within the scope of protection defined by the appended patent claims.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. It is the intention, therefore, to be limited only as indicated by the scope of the claims appended hereto.

I claim:

1. A process for applying a defined surface roughness to a metal strip for preventing a sticking of the metal strip during an annealing procedure in an arrangement comprising a reversing roll stand for cold rolling the metal strip, an annealing station for receiving the metal strip after the metal strip has been cold rolled, and a temper roll stand having flattening rolls for conducting at least one flattening pass of the metal strip after the metal strip has been annealed in the annealing station, the process for applying a defined surface roughness comprising the steps of:

temporarily replacing the flattening rolls of the temper rolling stand which is used for conducting at least one post-annealing flattening pass of the metal strip with roughing rolls;

wet rolling the metal strip through the roughing rolls in the temper rolling stand before the metal strip is received in the annealing station for applying a defined roughness to the metal strip; and removing the roughing rolls and reinserting the flattening rolls into the temper rolling stand after the step of wet rolling so that the temper roll stand is usable for conducting at least one post-annealing flattening pass of the metal strip with the flattening rolls.

2. The process of claim 1, wherein said step of running the metal strip through the temper rolling stand with the roughing rolls further comprises the step of cooling the metal strip and the roughing rolls in the temper roll stand using a cooling installation in the temper roll stand.

3. The process of claim 1, wherein said step of running the metal strip through the temper rolling stand with the roughing rolls further comprises the step of washing the metal strip and roughing rolls in the temper roll stand using a washing installation in the temper roll stand.

4. The process of claim 1, wherein said step of running the metal strip through the temper rolling stand with the roughing rolls is performed directly after the metal strip is cold rolled in the reversing roll stand.

5. The process of claim 2, wherein said step of cooling comprises cooling the metal strip and the roughing rolls using water including a rustproofing agent.

6. The process of claim 3, wherein said step of washing comprises washing the metal strip and the roughing rolls using water including a rustproofing agent.

7. The process of claim 3, wherein said step of running the metal strip through the temper rolling stand with the roughing rolls further comprises the step of cooling the metal strip and the roughing rolls in the temper roll stand using a cooling installation in the temper roll stand.

8. The process of claim 3, wherein said step of washing comprises washing the metal strip and the roughing rolls using a cleaning detergent.

9. The process of claim 7, wherein said step of washing comprises washing the metal strip and the roughing rolls using a cleaning detergent.

* * * * *